US005163212A

United States Patent [19]

Nelson

[11] Patent Number: 5,163,212

[45] Date of Patent: Nov. 17, 1992

[54] SAFETY TOOL FOR HANDLING OF UNITIZED JAW ASSEMBLY IN POWER SUCKER ROD TONGS

[75] Inventor: Robert M. Nelson, Ventura, Calif.

[73] Assignee: Oil Country Manufacturing, Inc., Calif.

[21] Appl. No.: 766,574

[22] Filed: Sep. 27, 1991

[51] Int. Cl.[5] ..... B25B 27/14

[52] U.S. Cl. ..... 29/280

[58] Field of Search ..... 294/115, 19.1; 29/280, 29/281.4, 261, 262, 270, 240, 237

[56] References Cited

U.S. PATENT DOCUMENTS 3,312,496 4/1967 Boutelle et al. ..... 294/115

4,253,697 3/1981 Acosta ..... 294/19.1

4,830,565 5/1989 Bucher et al. ..... 294/115

FOREIGN PATENT DOCUMENTS 65250 4/1941 Norway ..... 294/115

*Primary Examiner*—Robert C. Watson

*Attorney, Agent, or Firm*—Natan Epstein

[57] ABSTRACT

A hand tool for safely removing and installing the unitized jaw assembly in power sucker rod tongs has a tool head equipped with spring loaded paws for gripping the jaw assembly. A tool handle allows rotation of the tool head with the jaw assembly to protect the tool operator against injury when installing or removing the jaw assembly from the power tongs.

13 Claims, 4 Drawing Sheets

SAFETY TOOL FOR HANDLING OF UNITIZED JAW ASSEMBLY IN POWER SUCKER ROD TONGS

BACKGROUND OF THE INVENTION

1. Field of the Invention

The present invention relates generally to the field of tooling used in the maintenance of oil well pumping equipment, and more particularly pertains to a hand tool for safely lifting and replacing the unitized jaw assembly in power sucker rod tongs.

2. Background of the invention

In certain oil wells the oil is recovered from underground reservoirs by means of a pump-jack installed at the surface and connected by a string of sucker rods to a pump valve located at the bottom of the oil well. The sucker rods are rigid rods threaded end-to-end to make up a string of the necessary length, depending on the depth of the particular oil well. This rigid string transmits up-and-down reciprocating motion from the pump jack to the underground pump valve. Each sucker rod is a round bar of steel which is upset at each end to form a square torquing shoulder section with a male threaded end. A coupling with mating female threads at each end is screwed to the ends of two adjacent sucker rods to make a rigid joint between them. This process is repeated to generate a string of the necessary length.

From time to time it is necessary to remove and reinstall the string of sucker rods. This operation is typically carried out with the aid of a hydraulically driven power sucker rod tongs. The power tongs includes a set of jaws which grip and rotate the sucker rod joint while a fixed wrench keeps a second, lower sucker rod joint from turning, thus providing the torque needed for turning the upper joint. The leading manufacturer of power sucker rod tongs is Byron Jackson Co., now BJ VARCO, which company designed and developed this tool more than twenty years ago. The direction of rotation of the jaws in the tongs, clockwise or counterclockwise, is controlled by a valve system which directs hydraulic pressure to a hydraulic motor which turns a bull gear in the center of the tool in one direction or the other. A unitized jaw assembly fits into the bull gear and has a latch mechanism which will permit rotation of the bull gear in only one direction or another depending on which side of the jaw assembly is facing up in the power tongs. With the unitized jaw assembly placed with one specific side up in the bull gear, the latch mechanism of the jaw assembly will permit only clockwise rotation of the bull gear. If the unitized jaw assembly is now removed, turned upside down and reinstalled into the bull gear, it will permit counterclockwise rotation. The unitized jaw assembly also has a small key on the outside, which must engage into a mating slot in the bull gear for proper installation and operation. If the unitized jaw assembly is not properly aligned, it will not permit the power sucker rod tongs to function. In addition, the bull gear has to be aligned with a sucker rod entry slot in the body of the power sucker rod tongs before the unitized jaw assembly can be removed or installed.

Inasmuch as the power sucker rod tongs are an old tool design, an operator normally uses his fingers to grasp and directly handle the unitized jaw assembly whenever its removal or replacement is needed. For this purpose finger holes are formed on both sides, top and bottom, of the unitized jaw assembly to provide a grip for the operator's fingers. Over the years, a number of operators have lost their fingers during this procedure, because the power tongs might start rotation while the operator's fingers are still engaged in the finger holes of the unitized jaw assembly. In response to these injuries, OSHA has required that the power sucker rod tongs must be disengaged from the hydraulic power source before removal or installation of the unitized jaw assembly is made. Workover rigs, which use power sucker rod tongs to handle the removal and replacement of sucker rod strings in an oil well, are very dirty and messy work places. Disconnected hydraulic fittings to the power sucker rod tongs are likely to get dirty, with contamination entering the hydraulic system, resulting in a shortened life of the hydraulic tools. Hydraulic oil may also spill and create slippery and dangerous work surfaces on the rig floor. If the bull gear is not properly aligned with the entry slot in the body of the power tongs, it becomes necessary to reconnect the hydraulic lines so that the bull gear can be rotated slightly. The hydraulic lines must then be again disconnected, so that the fingers of the operator can again try to remove the unitized jaw assembly. If the latter still does not come loose, the cycle is repeated until the bull gear is properly oriented. This problem is compounded by the need to orient the external key on the unitized jaw assembly with the keyway in the bull gear. All told, the removal and/or installation of the unitized jaw assembly can be a time consuming and dangerous operation with possible serious injury to the fingers and hands of the operator.

A continuing need exists for a safe and simple-to-use tool which will assist the operator in the removal and or installation of the unitized jaw assembly in power sucker rod tongs while maintaining the hands and fingers of the operator at a safe distance and protected from the moving parts of the power tongs, and thereby to avoid the need for disconnecting the hydraulic lines to the power tongs during this operation. This applicant is not aware of any existing tool suited to this purpose.

SUMMARY OF THE INVENTION

The present invention addresses the aforementioned need by providing a safety hand tool for removal and installation of the unitized jaw assembly in power sucker rod tongs which allows the operator to keep his fingers safely away from the jaw assembly, and which allows safe and easy handling of the jaw assembly without disconnecting the hydraulic system to the power tongs. The novel safety tool has a tool handle and a head attached to the handle for gripping the jaw assembly. The head has gripping elements engageable into the finger recesses of the jaw assembly for holding the jaw assembly to the tool head. The tool head is free to rotate with the jaw assembly in relation to the handle, thus protecting the operator's hands in the event the power tongs commences rotation while the tool is engaged to the unitized jaw assembly.

In a presently preferred form of the invention, the handle is an elongated tube with a free end and an opposite stabbing end attached to the tool head. The tool head grips the unitized jaw assembly by means of diametrically opposed spring loaded paws shaped and configured to enter the finger recesses and grasp the jaw assembly between them when the tool head is manually urged against the jaw assembly. The tool head is axially fixed to the lower end of a rod telescopically slidable within the tubular handle. The rod and the handle are spring biased to a telescopically extended condition, preferably by the same spring which also drives the diametrically opposed paws towards each other for gripping the unitized jaw assembly. The paws have camming surfaces shaped and configured to act against the jaw assembly and move the paws apart as the head is advanced into mating engagement with the jaw assembly. Once the camming surfaces clear the rim of the jaw assembly the paws move into the finger recesses and are held in frictional engagement against the surface of the recess by the force of the biasing spring. The unitized jaw assembly can then be raised with the tool and lifted out of the bull gear. The paws can be retracted from the finger recesses by applying a downward axial force to the tool handle while also applying a side force to the tool handle. This causes the grip of the paws to move out of and away from the finger recesses in the jaw assembly.

In one form of the invention the tool head also has indexing elements adapted to mate with existing indexing holes in the jaw assembly to assure circumferential alignment of the gripping elements with the finger recess. The indexing elements conveniently are protruding bolt heads which also hold together parts of the tool head and are arranged to mate into existing holes in the unitized jaw assembly to assure alignment of the paws with the finger recesses.

These and other features and advantages of the present invention will be better understood by turning to the following detailed description of the preferred embodiments, considered with reference to the attached drawings.

DETAILED DESCRIPTION OF THE PREFERRED EMBODIMENT

Figure 1:
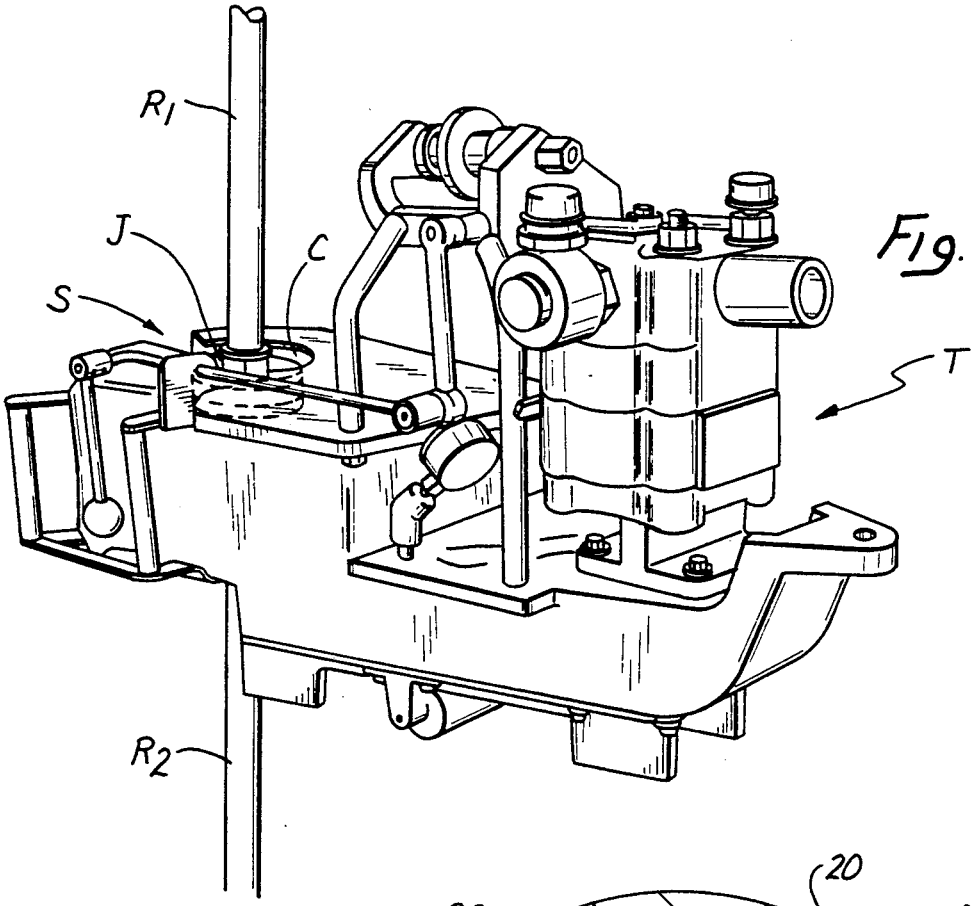
FIG. 1 is a perspective view of a typical power sucker rod tongs unit in use on a sucker rod string.
Figure 5:
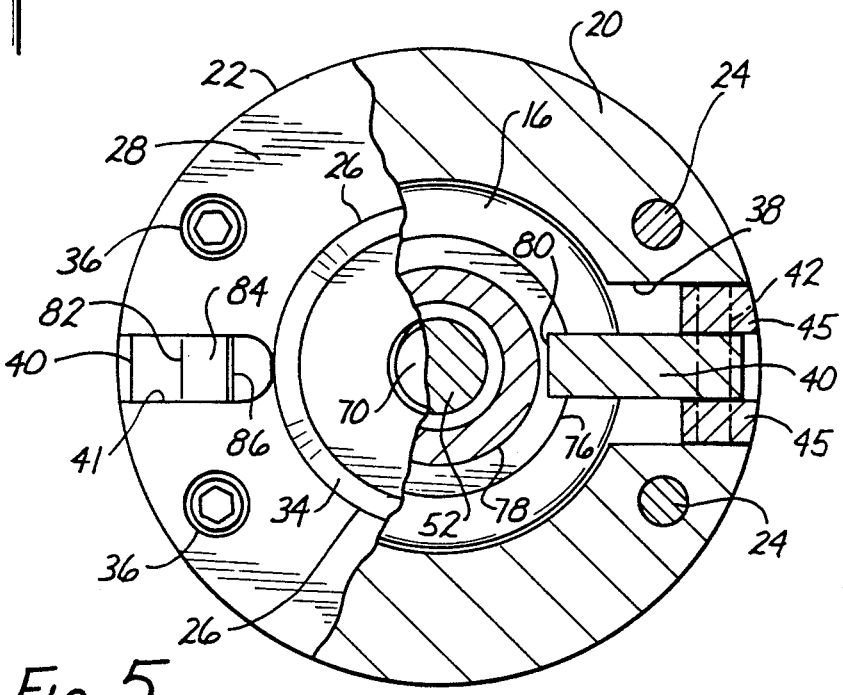
FIG. 5 is a bottom end view of the tool partly in section taken along line 5—5 in FIG. 3.

With reference to the attached drawings, FIG. 1 shows a typical power sucker rod tongs T in position for turning a joint J between two sucker rods R1 and R2 which form part of a longer string of similar sucker rods. The string connects a pump jack (not shown) above rod R1 to a pump valve at the bottom of an oil well below rod R2. The construction and operation of power sucker rod tongs is well known and need not be described here in detail. Briefly, the power tongs T is connected to a source of hydraulic power, not shown in the drawing, which drives a bull gear enclosed by the body of the power tongs in FIG. 1. An entry slot S in the body of the power tongs admits the sucker rod string into a unitized jaw assembly mounted in the bull gear. Both the bull gear and the unitized jaw assembly have radial slots which must align with the entry slot S when the sucker rod string is being engaged or disengaged by the power tongs T. The power tongs T is pushed into position against the sucker rod string by the tool operators while the power tongs is suspended by a chain from a winch (not shown) positioned near the sucker rod string. When power is applied to the tool, the lower sucker rod R2 is locked against rotation by a lower wrench on the power tongs while the upper sucker rod R1 is turned in order to break the threaded joint. Conversely, a joint can be tightened by reversing rotation of the tool.

Figure 2:
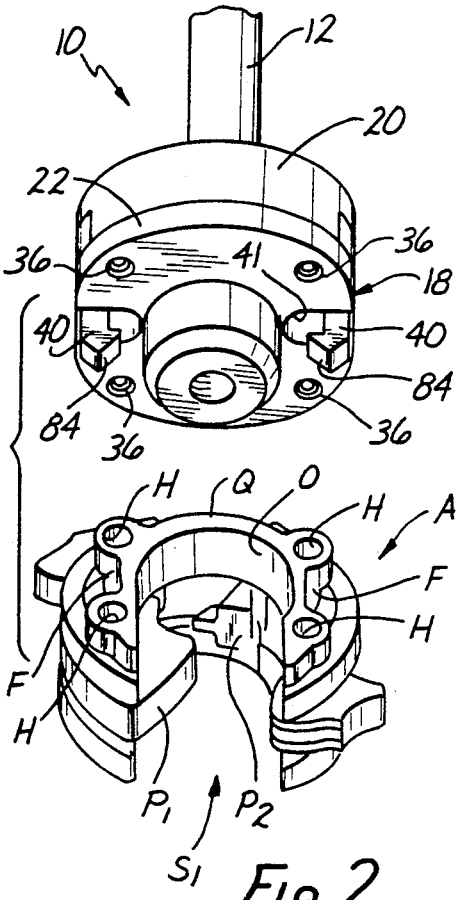
FIG. 2 shows in perspective view the bottom of the safety tool positioned above the unitized jaw assembly unit.

FIG. 2 shows a unitized jaw assembly A which has been removed from the power tongs T in FIG. 1. The unitized jaw assembly has a radial slot S1 which, when aligned with the entry slot S of the power tongs T in FIG. 1, admits the sucker rod string into the center of the jaw assembly A, where the torquing shoulders on the sucker rod end are engaged between a pair of movable jaws within a central opening O. These jaws are pivoted such that torquing force is applied by the jaws to the sucker rod joint J only for a given sense of rotation of the unitized jaw assembly. For an opposite sense of rotation the jaws retract out of engagement with the sucker rod string. Therefore, the unitized jaw assembly must be placed in the bull gear in the power tongs T with a given side up when breaking a threaded joint in the sucker rod string, and has to be turned upside down in the bull gear in order to subsequently make a threaded joint in the sucker rod string. The jaw assembly also has four holes H on each side of the jaw assembly arranged in a rectangular array. Two of these holes on each side of the jaw assembly are used to hold pivot pins for the two jaws P1 and P2. The other two holes on each side are empty. However, even the holes which receive the pivot pins are unoccupied and empty to a depth of approximately ½ inch. The four holes H on each side of the jaw assembly are formed in bosses connected by a semicircular ridge Q extending around the central opening O. Diametrically opposed finger holes F are recessed radially into the outside surface of the ridge Q between pairs of holes H on either side of the entry slot S1. As seen in elevational cross section in FIG. 6, finger recesses F are shallow depressions underneath a rim or lip L and have ramping surfaces E. Current practice is for the tool operator to grasp the jaw assembly between both hands, with fingers of each hand in a corresponding finger recess F, as the unitized jaw assembly is lifted out of or placed in the bull gear in the power tongs. Two such pairs of diametrically opposed finger recesses F are provided on the jaw assembly A, one pair on each of the upper and lower sides of the jaw assembly. The two sides of the jaw assembly are generally mirror images of each other in a mirror plane cutting the jaw assembly horizontally in FIG. 6 midway between the upper and lower sides.

Figure 3:
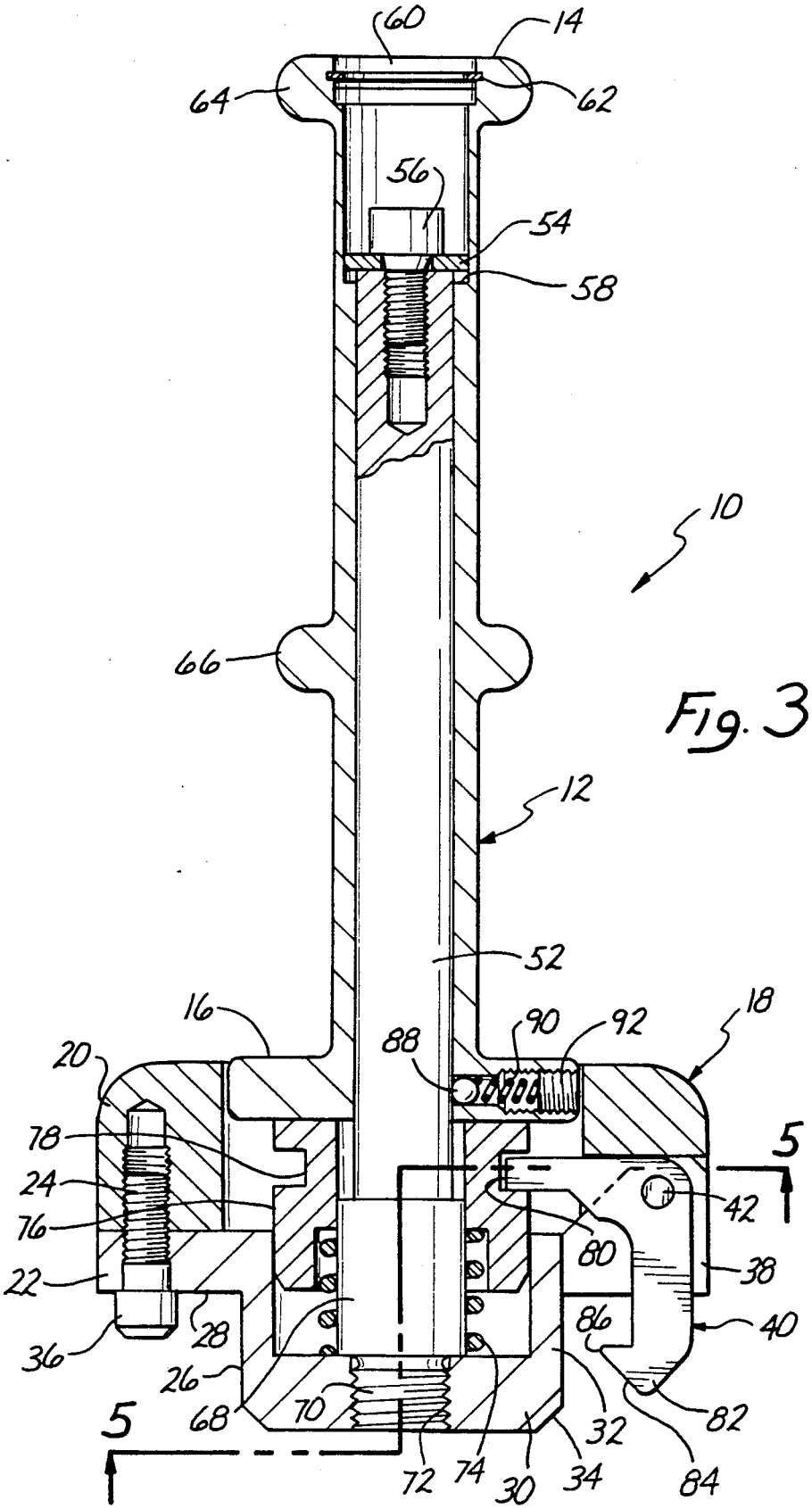
FIG. 3 is a longitudinal section of one form of the tool of this invention provided with protruding indexing bolt heads but otherwise similar to the tool of FIG. 4.

The safety tool 10 of this invention for handling the unitized jaw assembly A of FIG. 2 is shown in detail in FIGS. 3 through 6. Turning to FIG. 3, the safety tool 10 has an elongated tool handle 12 with a free end 14 and an annular end flange 16 at an opposite stabbing end to which is attached a tool head 18. The tool head 18 includes a ring 20 rotatable about the end flange 16 of the tool handle, and an annular end piece 22 fixed to the bottom of the ring 20 by four threaded bolts 24, best seen in the bottom end view of FIG. 5. The bottom of end piece 22 includes an end projection in the form of cylindrical nose 26 centered in an annular shoulder 28. The nose 26 includes a cylindrical side wall 32 terminating at an end wall 30, and an annular bevel 34 connecting the outer surfaces of the end wall 30 and side wall 32. The cylindrical wall 32 of nose 26 has a diameter sized to make a close sliding fit into the central opening 0 of the unitized jaw assembly A cylindrical rod 52 is telescopically slidable within the hollow interior of the handle 12. The handle 12 slides telescopically along the rod 52 from its normal telescopically extended position of FIG. 3 to a telescopically retracted position shown in FIG. 4. A disk 54 is fixed to the upper end of the rod 52 by a bolt 56, and acts against a shoulder 58 to limit telescopic extension of the rod 52 relative to the handle 12. The upper end of the handle 12 is closed by a plug 60 held in place by a radial spring ring 62. The handle 12 also has an annular end bead 64 and a second annular bead 66 at an intermediate point of the handle. The two beads 64, 66 help keep the tool from slipping from the hands of an operator. A steel ball 88 is captive in a radial bore defined in the annular flange 16 of the tool handle and is urged against the surface of the rod 52 by a coil spring 90 captive between ball 88 and a threaded plug 92 which closes the outer end of the radial bore. The spring loaded ball 88 provided a degree of frictional drag when rotating against the rod 52 as the tool handle 12 is turned about its axis, and keeps the tool head 18 from spinning unnecessarily about the tool handle.

The lower end of the rod 52 has an enlarged cylindrical section 68 and an end thread 70 threaded into a female thread 72 centered in the end wall 30 of the nose 26. A compression coil spring 74 is axially mounted on the enlarged portion 68 of the rod 52 and is captive between the end wall 30 of the nose and a cylindrical collar 76. Collar 76 is slidable on the enlarged section 68 and is held against the end flange 16 of the tool handle by the spring 74. The force of spring 74 through collar 76 normally drives the tool handle 12 to the telescopically extended condition of FIG. 3. The tool handle 14 is free to turn against the collar 76.

The ring 20 has diametrically opposed radial slots 38. A pair of parallel flanges 45 extends upwardly and outwardly from the cylindrical nose 36 into each slot 38. An L-shaped paw 40 is pivoted on a pin 42 between each pair of flanges 45. Each paw 40 has a horizontal arm from the pivot point 42 to an inner end 80 which is received in an annular recess 78 of the collar 76. Each paw 40 also has a vertical arm which extend through narrower radial slots 41 in the end piece 22 and terminate in a lower end 82 which includes a camming edge 84 and a detent edge 86.

Figure 6:
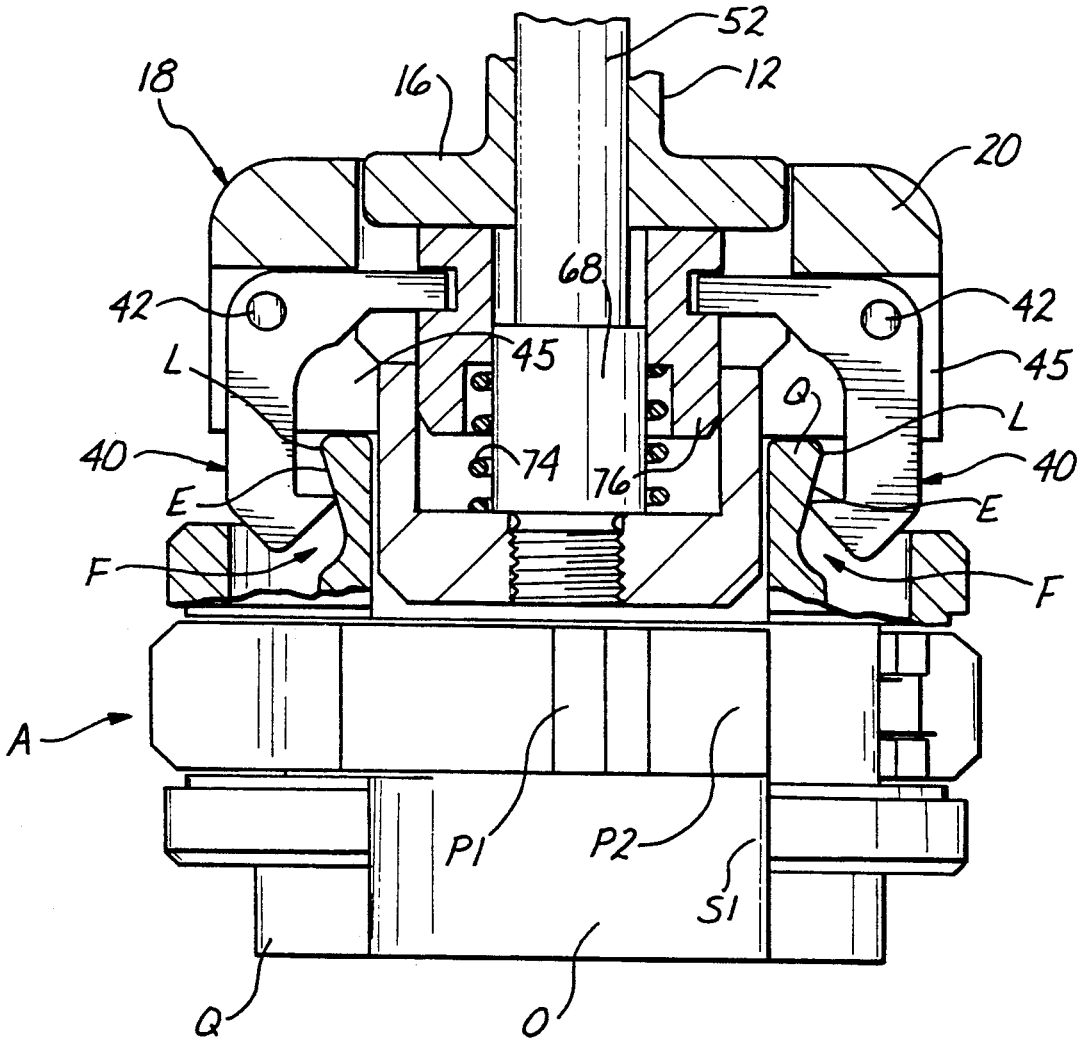
FIG. 6 is a longitudinal section of the tool head of FIG. 4 with the paws engaged into the finger recesses of the unitized jaw assembly.

Use of the tool 10 will now be described. FIG. 2 shows the tool head 18 advancing towards engagement with the jaw assembly A, and FIG. 6 shows the tool head 18 engaged to the untized jaw assembly A. The tool is placed above the jaw assembly and the two paws 40 are visually aligned with the finger recesses F in the jaw assembly by turning the head 18. The nose 26 is then advanced into opening 0 until the bolt heads 36 come into contact with the ridge Q. The nose 26 centers the tool head 18 and aligns the axis handle of handle 14 in relation to the jaw assembly. As the tool is then pushed further against the jaw assembly the camming edges 84 of the two paws 40 contact the upper lip L above the finger recesses F. The slanted camming edges cause the lower ends 82 to spread apart and the paws 40 to turn about pivot 42 as the tool head continues to advance into the jaw assembly. The inner ends 80 of the paws swing downwardly and drive the collar 76 down along the rod 52 compressing spring 74. The compressed spring 74 pushes the collar 78 and the inner paw ends 80 upwardly, biasing the lower ends 82 towards each other to a normal, jaw assembly engaging condition illustrated in FIGS. 3 and 6. As the paws reach a level below the lip L, the spring bias urges the detent edges 86 towards each other and firmly against the ramped surfaces E of the finger recesses. The force of the spring 74 is selected to exert sufficent force to hold the weight of the jaw assembly by frictional engagement between the detent edges 86 and the surfaces E of the finger recesses.

Figure 4:
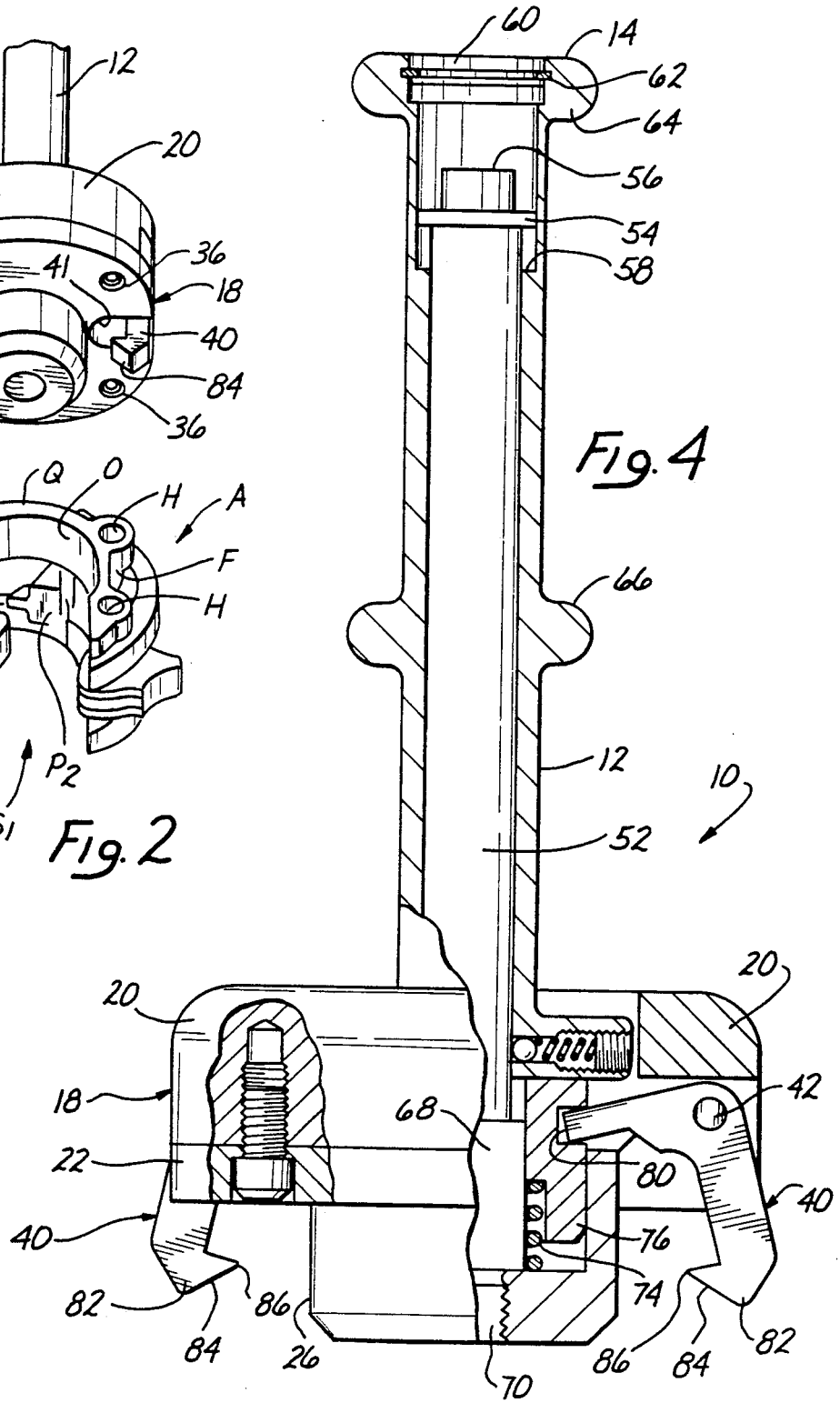
FIG. 4 is a longitudinal view partly in cross section showing a preferred embodiment of the novel tool actuated to its jaw assembly releasing condition by driving the tool handle towards the tool head for disengagement from the unitized jaw assembly.

The jaw assembly A is released from the tool head by pushing the tool handle 12 axially along the rod 52 down against the tool head 18, to the retracted position of FIG. 4, so that the end flange 16 drives the collar 76 downwardly along the rod 52 against the force of spring 74. The inner ends 80 of the paws are carried down with the collar 76, turning each paw about its own pivot 42, so that the lower ends 82 of the paws 40 retract away from each other and out of the finger recesses F in the jaw assembly and allow the tool head 18 to separate from the jaw assembly A. Release of the jaw assembly from the tool head 18 is most expediently accomplished by striking the free end 14 of the tool handle with the heel of the tool operator's hand, which momentarily drives the collar 76 down against the spring 74 and pivots the paws 40 apart and out of the finger recesses F. This release operation may be expediently accomplished by striking the upper end of the handle with the heel of the hand perpendicular to the axis of the handle while allowing the fingers to grasp the handle. This causes the paw ends 84 to move out of and away from the finger recesses F in the jaw assembly. The spring 74 returns the tool head to the normal condition shown in FIG. 5 as soon as axial force is removed from the end of the tool handle.

In a modified form of the tool 10 shown in FIG. 3, the four bolts 24 each have an exposed bolt head 36 which protrudes below the annular shoulder 28. The bolt heads are sized to mate into the holes H of the unitized jaw assembly A. are arranged on the shoulder 28 in a rectangular pattern matching the arrangement of the holes H of the unitized jaw assembly. The existing holes H and the bolt heads 36 serve as indexing holes and indexing pins respectively for assuring proper circumferential alignment of the paws 40 with the finger recesses F. The tool handle 12 is turned until the four bolt heads 36 align with and mate into the four holes H. When this occurs the paws 40 are in circumferential alignment with the finger recesses F of the unitized jaw assembly. This mechanical indexing substitutes for visual alignment of the paws in the presently preferred embodiment of FIGS. 2, 4 and 6.

It will be appreciated that the safety tool 10 protects the tool operator at all times against injury to his fingers or hands while removing or replacing the unitized jaw assembly A in the power tongs T. The operator does not have to reach with his hands into the cavity C in the power tongs. Instead, it is the tool head 18 which is inserted into the power tongs, while the operator's hands hold the tool handle 12 at a safe distance from the interior of the power tongs. Further, in the event that the power tongs is accidentally activated while the tool head 18 is fully or partially engaged to the unitized jaw assembly A, the tool head 18 is free to turn with the unitized jaw assembly without however transmitting significant torque to the tool handle 12, which remains stationary in the operator's hand. This important feature positively prevents the operator's hands from being twisted and possibly injured even in the event of accidental operation of the power tongs T.

While a particular embodiment of the invention has been described and illustrated for purposes of clarity and example, it must be understood that many changes, substitutions and modifications can be made to the described embodiment by those possessed of ordinary skill in the art, without thereby departing from the scope and spirit of the present invention, which is defined by the following claims.

What is claimed is:

1. Safety tool for installation and removal of the unitized jaw assembly in power sucker rod tongs of the type where the jaw assembly has finger recesses and indexing holes, said tool comprising:

a tool handle, a tool head attached to said handle for engaging and holding the jaw assembly to said tool head, said head being free for rotation with said jaw assembly in relation to said handle, said head including a cylindrical end projection metable to a central recess in the jaw assembly and indexing pins metable to indexing holes in the jaw assembly for aligning said paws with said finger recesses.

2. The tool of claim 1 wherein said head has paws engageable into the finger recesses of the jaw assembly, said paws are diametrically opposed on said head and are normally spring loaded towards a jaw assembly engaging position, said paws being shaped and configured to engage said finger recesses in response to urging of said head against said jaw assembly.

3. The tool of claim 1 wherein said handle is elongated between said head and a distal end, said head is rotable about an axis aligned with said handle, and said handle is axially displaceable through a disengagement stroke relative to said head between an extended and a retracted position, said handle being normally spring biased towards said extended position, whereby the jaw assembly can be released from said head by driving said handle axially towards said head.

4. The tool of claim 3 wherein said handle is tubular and said head is axially fixed to a lower end of a rod telescopically slidable within said handle, said rod having stop means for limiting telescoping extension of said rod and said handle.

5. Safety tool for installation and removal of the unitized jaw assembly in power sucker rod tongs of the type where the jaw assembly has finger recesses and indexing holes, said tool comprising:

a tubular tool handle having an upper end and an open lower end, a rod telescopically slidable in said lower end, a tool head attached to a lower end of said rod and rotatable in relation to said handle, diametrically opposed paws pivoted to said head and engageable into the finger recesses for holding the jaw assembly to said head, a biasing spring normally urging said paws to a recess engaging position, said paws being movable for releasing the jaw assembly from said head in response to telescoping displacement of said handle along said rod against said biasing spring to a retracted position, said tool head including a cylindrical end projection mateable to a central opening in the unitized jaw assembly and indexing pins mateable to said indexing holes in the jaw assembly for circumferentially aligning said paws with said finger recesses.

6. The tool of claim 5 further having stop means for limiting telescoping extension of said rod and said handle, said biasing spring normally urging said rod towards an extended position from said handle and said paws towards a recess engaging position.

7. The tool of claim 6 wherein said biasing spring is a compression spring coaxial with said rod and captive between said head and said handle.

8. The tool of claim 5 wherein said paws are generally L-shaped, each paw having an inner end and a lower end, said paws being pivoted to said head at a point intermediate said inner and outer ends, said lower end being engageable into said recesses, said inner end being engaged by said spring for holding said paws in said recess engaging position, said handle acting on said inner ends for moving the lower ends of said paws to said retracted position.

9. Safety tool for installation and removal of the unitized jaw assembly in power sucker rod tongs of the type where the jaw assembly has finger recesses, and a central opening, said tool comprising:

a tubular tool handle axially displaceable on a rod, a tool head attached to a lower end of said rod and rotatable in relation to said handle, diametrically opposed paws pivoted to said head and engageable into the finger recesses for holding the jaw assembly to said head, said head further having a cylindrical nose mateable to said central opening, a compression spring coaxial with said rod and captive between said head and said handle normally urging said handle to an extended condition on said rod and said paws to a recess engaging position, said handle being movable along said rod against said spring to a retracted position for pivoting said paws out of engagement with said finger recesses to release the jaw assembly from said head.

10. The safety tool of claim, 9 wherein said lower end of each paw has a camming edge for separating the lower ends as said tool head is advanced into mating engagement with said unitized jaw assembly and a detent edge for retaining said jaw assembly to said tool head in mating engagement.

11. The safety tool of claim 1 wherein said jaw assembly has a plurality of holes, said tool further comprising indexing means mateable to said holes for circumferentially aligning said paws with said finger recesses.

12. The safety tool of claim 5 wherein said jaw assembly has a plurality of holes, said tool further comprising indexing means mateable to said holes for circumferentially aligning said paws with said finger recesses.

13. The safety tool of claim 9 wherein said jaw assembly has a plurality of holes, said tool further comprising indexing means mateable to said holes for circumferentially aligning said paws with said finger recesses.

* * * * *